US009685261B2

(12) United States Patent
Adamson et al.

(10) Patent No.: US 9,685,261 B2
(45) Date of Patent: Jun. 20, 2017

(54) FORMATION OF A TRANSPARENT CONDUCTIVE FILM BY INTERFACIAL GRAPHENE ASSEMBLY

(71) Applicant: University of Connecticut, Farmington, CT (US)

(72) Inventors: Douglas H. Adamson, Mansfield Center, CT (US); Steven Woltornist, Willington, CT (US); Andrey V. Dobrynin, Willington, CT (US)

(73) Assignee: University of Connecticut, Farmington, CT (US)

( * ) Notice: Subject to any disclaimer, the term of this patent is extended or adjusted under 35 U.S.C. 154(b) by 308 days.

(21) Appl. No.: 14/248,547

(22) Filed: Apr. 9, 2014

(65) Prior Publication Data

US 2014/0305571 A1 Oct. 16, 2014

Related U.S. Application Data

(60) Provisional application No. 61/812,285, filed on Apr. 16, 2013.

(51) Int. Cl.

| | |
|---|---|
| ***H01B 13/00*** | (2006.01) |
| ***H01B 1/00*** | (2006.01) |
| ***H01B 13/30*** | (2006.01) |
| ***H01B 1/04*** | (2006.01) |

(52) U.S. Cl.

CPC ..... *H01B 13/30* (2013.01); *H01B 1/04* (2013.01)

(58) Field of Classification Search

CPC . H01B 1/00; H01B 1/04; H01B 13/00; H01B 13/30

See application file for complete search history.

(56) References Cited

U.S. PATENT DOCUMENTS

| | | | | |
|---|---|---|---|---|
| 7,449,133 | B2 | 11/2008 | Gruner et al. | |
| 7,824,651 | B2 | 11/2010 | Zhamu et al. | |
| 2015/0118144 | A1* | 4/2015 | Cao | C01G 19/00 423/508 |

OTHER PUBLICATIONS

Wang et al., Transparent, Conductive Graphene Electrodes for Dye-Sensitized Solar Cells, Nano Letters, vol. 8, No. 1, pp. 323-327, 2008.

Coleman, Liquid-Phase Exfoliation of Nanotubes and Graphene, Advanced Functional Materials, vol. 19, pp. 3680-3695, 2009.

Wang et al. Wettability and Surface Fee Energy of Graphene Films, Langmuir, vol. 25, No. 18, pp. 11078-110814, 2009.

Gomez-Navarro et al. Atomic Structure of Reduced Graphene Oxide, Nano Letters, vol. 10, pp. 1144-1148, 2010.

Witten, T. et al., Pincus. Structured Fluids: Polymers, Colloids, Surfactants. Oxford: Oxford UP, 2010.

Biswas et al., Graphene Versus Carbon Nanotubes in Electronic Devices, Advanced Functional Materials, vol. 21, pp. 3806-3826, 2011.

Coleman et al., Two-Dimensional Nanosheets Produced by Liquid Exfoliation of Layered Materials, American Association for the Advancement of Science, Science, vol. 331, 568-571, 2011.

Domingues et al, Transparent and Conducive Thin Films of Graphene/Polyaniline Nanocomposites Prepared Through Interfacial Polymerization, Chemical Communications, vol. 47, 2592-2594, 2011.

Li et al., Large-Area Graphene Single Crystals Grown by Low-Pressure Chemical Vapor Deposition of Methane on Copper, Journal of the American Chemical Society, vol. 133, pp. 2816-2819, 2011.

Suk et al., Transfer of CVD-Grown Monolayer Graphene onto Arbitrary Substrates, ACS Nano, vol. 5, No. 9, pp. 6916-6924, 2011.

Töelle et al., Emulsifier-Free Graphene Dispersions with High Graphene Content for Printed Electronics and Freestanding Graphene Films, Advanced Functional Materials, vol. 22, 1136-1144, 2012.

* cited by examiner

*Primary Examiner* — Michael N Orlando
*Assistant Examiner* — Matthew Hoover
(74) *Attorney, Agent, or Firm* — McCarter & English, LLP

(57) ABSTRACT

Advantageous films and coatings (e.g., transparent conductive films), and improved methods for fabricating such films and/or coatings, are provided. The improved methods for fabricating transparent conductive films/coatings may involve trapping at least a portion of a layered material (e.g., graphene sheet(s) or layer(s) of graphite) at an interface of a phase separated system (e.g., at an interface of two non-mixing solvents). Transparent, one to four layer, conductive films/coatings of pristine natural flake graphene are produced by kinetically trapping graphene sheets at an interface of a phase separated system (e.g., at an oil/water interface).

20 Claims, 14 Drawing Sheets

Floating film

Lifting film

FORMATION OF A TRANSPARENT CONDUCTIVE FILM BY INTERFACIAL GRAPHENE ASSEMBLY

CROSS-REFERENCE TO RELATED APPLICATION

The present application claims priority benefit to a provisional patent application entitled "Formation of Transparent Conductive Film by Interfacial Graphene Assembly," which was filed on Apr. 16, 2013, and assigned Ser. No. 61/812,285. The entire content of the foregoing provisional patent application is incorporated herein by reference.

BACKGROUND

Technical Field

The present disclosure relates to films/coatings (e.g., transparent conductive films/coatings) and methods for fabricating films/coatings and, more particularly, to methods for fabricating transparent conductive films by trapping at least a portion of a layered material (e.g., graphene sheet(s) or layer(s) of graphite) at an interface of a phase separated system (e.g., at an interface of two non-mixing solvents).

Background Art

In general, current attempts to use graphene for some applications (e.g., graphene film applications) involve the use of oxidized graphene (GO—graphene oxide), followed by a thermal reduction between about 400° C. and about 1000° C. Moreover, some currently used transparent conductive coatings typically employ indium tin oxide (ITO), a rare, expensive and brittle material.

In general, graphite's lack of solubility is an obstacle to its utilization, and is sometimes attempted to be overcome by oxidizing and sonicating the graphite to obtain aqueous suspensions, followed by reduction after processing. However, the oxidation and reduction process significantly degrades the properties of the graphene. See, e.g., U.S. Pat. Nos. 7,824,651 and 7,449,133, the entire contents of each being hereby incorporated by reference in their entireties.

For example, the lack of graphene solubility has necessitated the use of graphene oxide (GO), reduced GO (rGO) or chemical vapor deposition (CVD) sources, rather than pristine, naturally derived graphene to produce transparent conducting films. (See, e.g., D. S. Hecht, L. Hu, G. Irvin, *Advanced Materials*, (2011)).

While the production of CVD grown graphene sheets with large lateral dimensions has been demonstrated, the cost of this process generally limits the possible applications. (See, e.g., X. Li et al., *Journal of the American Chemical Society* 133, 2816 (Apr. 9, 2011); and J. W. Suk et al., *ACS Nano* 5, 6916 (Sep. 27, 2011)). The use of rGO is sometimes reported, despite the fact that rGO's electrical conductivity is about one to two orders of magnitude less than that of graphene (C. Gómez-Navarro et al., *Nano Letters* 10, 1144 (May 14, 2010)). Moreover, reports of graphitic films also discuss the use of GO layered with conducting polymers, and films of temperature treated GO (See, e.g., S. H. Domingues at al., Chemical Communications 47, 2592 (2011); and F. J. Toelle et al., *Advanced Functional Materials* 22, 1136 (2012)).

Thus, an interest exists for improved films/coatings (e.g., transparent conductive films/coatings), and related methods for fabricating improved films/coatings. These and other inefficiencies and opportunities for improvement are addressed and/or overcome by the assemblies, systems and methods of the present disclosure.

SUMMARY

The present disclosure provides advantageous films/coatings (e.g., transparent conductive films/coatings), and improved methods for fabricating such films/coatings. More particularly, the present disclosure provides improved methods for fabricating transparent conductive films/coatings by trapping at least a portion of a layered material (e.g., graphene sheet(s) or layer(s) of graphite) at an interface of a phase separated system (e.g., at an interface of two non-mixing solvents).

In exemplary embodiments, the present disclosure provides that when two non-mixing solvents (e.g., heptane and water) are placed together, they form an interface. When pristine or substantially pristine graphite is placed in this phase separated system and thereafter sonicated, the graphene will remain at the interface as well as climb the walls of the housing (e.g., glass sample vial) containing the solvents and graphite. By inserting a substrate (e.g., glass microscope slide) through the interface and agitating (e.g., shaking, mixing, stirring, blending) the system, the graphene will climb the substrate (e.g., slide), and after removal from the solvent system, will dry to form a transparent (e.g., substantially optically transparent), conductive (e.g., electrically conductive), graphene film. In certain embodiments, the present disclosure provides for substantially transparent, one to four layer, conductive films of pristine natural flake graphene by kinetically trapping graphene sheets at an interface of a phase separated system (e.g., at an oil/water interface, or at an interface between two non-mixing solvents).

The present disclosure provides for a method for fabricating a film or coating including: a) providing a phase separated system, the phase separated system including: (i) a first material and a second material, and (ii) an interface between the first and second materials; b) introducing a layered material to the phase separated system; c) inserting a substrate into the interface of the phase separated system and allowing at least a portion of the layered material to be associated with the substrate; d) removing the substrate from the phase separated system and allowing the portion of the layered material associated with the substrate to dry.

The present disclosure also provides for a method for fabricating a film or coating wherein the layered material includes graphite. The present disclosure also provides for a method for fabricating a film or coating wherein the layered material is substantially pristine and naturally derived graphite. The present disclosure also provides for a method for fabricating a film or coating wherein the dried portion of the layered material associated with the substrate is substantially transparent and electrically conductive.

The present disclosure also provides for a method for fabricating a film or coating wherein the phase separated system is an oil and water based system. The present disclosure also provides for a method for fabricating a film or coating wherein the phase separated system is a system of two substantially non-mixing solvents. The present disclosure also provides for a method for fabricating a film or coating wherein the first material is water and the second material is heptane.

The present disclosure also provides for a method for fabricating a film or coating wherein the substrate includes glass. The present disclosure also provides for a method for fabricating a film or coating wherein the substrate is substantially hydrophilic. The present disclosure also provides for a method for fabricating a film or coating wherein after inserting the substrate into the interface of the phase separated system, at least a portion of the layered material moves along a surface of the substrate.

The present disclosure also provides for a method for fabricating a film or coating wherein the portion of the layered material associated with the substrate includes graphene. The present disclosure also provides for a method for fabricating a film or coating wherein the portion of the layered material associated with the substrate includes from about one sheet or layer to about four sheets or layers of graphene.

The present disclosure also provides for a method for fabricating a film or coating wherein the graphene is substantially pristine natural flake graphene. The present disclosure also provides for a method for fabricating a film or coating wherein after step b), the phase separated system is sonicated or agitated.

The present disclosure also provides for a method for fabricating a film or coating wherein during step c), the phase separated system is sonicated or agitated. The present disclosure also provides for a method for fabricating a film or coating further including the steps of: e) inserting the substrate and the dried portion of the layered material associated with the substrate into a fluid so that the dried portion of the layered material floats on or in the fluid; f) inserting a second substrate into the fluid; and g) removing the dried portion of the layered material from the fluid via the second substrate.

The present disclosure also provides for a method for fabricating a film or coating wherein the fluid is water. The present disclosure also provides for a method for fabricating a film or coating wherein the second substrate is metal or plastic.

The present disclosure also provides for a method for fabricating a film or coating including: a) providing a phase separated system, the phase separated system including: (i) water and heptane, and (ii) an interface between the water and the heptane; b) introducing substantially pristine graphite to the phase separated system; c) sonicating the phase separated system; d) inserting a hydrophilic substrate into the interface of the phase separated system and allowing at least a portion of the substantially pristine graphite to be associated with the hydrophilic substrate; e) removing the hydrophilic substrate from the phase separated system and allowing the portion of the substantially pristine graphite associated with the hydrophilic substrate to dry; wherein the dried portion of the substantially pristine graphite associated with the substrate is substantially transparent and electrically conductive; wherein after inserting the hydrophilic substrate into the interface of the phase separated system, at least a portion of the substantially pristine graphite moves along a surface of the hydrophilic substrate; wherein the portion of the substantially pristine graphite associated with the hydrophilic substrate includes from about one sheet or layer to about four sheets or layers of graphene; and wherein during step d), the phase separated system is sonicated or agitated.

The present disclosure also provides for a method for fabricating a film or coating including: a) providing a phase separated system, the phase separated system including: (i) water and heptane, and (ii) an interface between the water and the heptane; b) introducing substantially pristine graphite to the phase separated system; c) sonicating the phase separated system; d) inserting a hydrophilic substrate into the interface of the phase separated system and allowing at least a portion of the substantially pristine graphite to be associated with the hydrophilic substrate; e) removing the hydrophilic substrate from the phase separated system and allowing the portion of the substantially pristine graphite associated with the hydrophilic substrate to dry; f) inserting the substrate and the dried portion of the substantially pristine graphite associated with the hydrophilic substrate into a fluid so that the dried portion of the substantially pristine graphite floats on or in the fluid; g) inserting a second substrate into the fluid; and h) removing the dried portion of the substantially pristine graphite from the fluid via the second substrate; wherein the dried portion of the substantially pristine graphite is substantially transparent and electrically conductive.

Any combination or permutation of embodiments is envisioned. Additional advantageous features, functions and applications of the disclosed assemblies, systems and methods of the present disclosure will be apparent from the description which follows, particularly when read in conjunction with the appended figures. All references listed in this disclosure are hereby incorporated by reference in their entireties.

BRIEF DESCRIPTION OF THE DRAWINGS

Features and aspects of embodiments are described below with reference to the accompanying drawings, in which elements are not necessarily depicted to scale.

Exemplary embodiments of the present disclosure are further described with reference to the appended figures. It is to be noted that the various steps, features and combinations of steps/features described below and illustrated in the figures can be arranged and organized differently to result in embodiments which are still within the spirit and scope of the present disclosure. To assist those of ordinary skill in the art in making and using the disclosed systems, assemblies and methods, reference is made to the appended figures, wherein.

DESCRIPTION OF EXEMPLARY EMBODIMENT(S)

Figure 1:
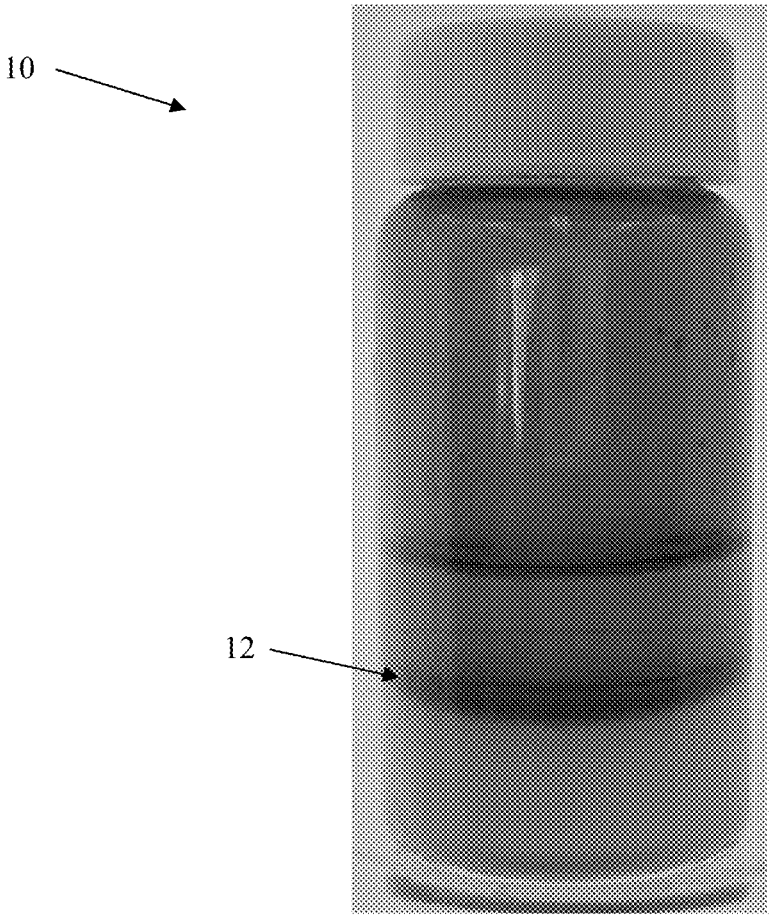
FIG. 1 is an image depicting two exemplary non-mixing solvents (e.g., heptane and water) placed together in a container (e.g., glass sample vial), and forming an interface of a phase separated system.

The exemplary embodiments disclosed herein are illustrative of advantageous films/coatings (e.g., transparent conductive films), and systems of the present disclosure and methods/techniques thereof. It should be understood, however, that the disclosed embodiments are merely exemplary of the present disclosure, which may be embodied in various forms. Therefore, details disclosed herein with reference to exemplary films/fabrication methods and associated processes/techniques of assembly and use are not to be interpreted as limiting, but merely as the basis for teaching one skilled in the art how to make and use the advantageous films/systems and/or alternative films/coatings of the present disclosure.

The present disclosure provides improved films/coatings (e.g., transparent conductive films), and improved methods for fabricating such films/coatings. More particularly, the present disclosure provides advantageous methods for fabricating transparent conductive films/coatings by trapping at least a portion of a layered material (e.g., graphene sheet(s) or layer(s) of graphite) at an interface of a phase separated system (e.g., at an interface of two non-mixing solvents).

Current practice provides that the lack of graphene solubility has necessitated the use of graphene oxide (GO), reduced GO (rGO) or chemical vapor deposition (CVD) sources, rather than pristine, naturally derived graphene to produce transparent conducting films. Stated another way, current practice provides that conventional methods utilize either CVD grown graphene, or use chemically modified graphite to fabricate transparent conductive films of graphene. However, CVD is very expensive, as only a single sheet of graphene can typically be grown at a time, and chemically modified graphite or reduced graphene oxide requires a high temperature treatment and has significantly inferior properties. Furthermore, some currently used transparent conductive coatings typically employ indium tin oxide (ITO), which is a rare, expensive and brittle material.

In exemplary embodiments, the present disclosure provides for improved methods for fabricating films/coatings (e.g., transparent conductive films) by trapping graphene sheets or the like (e.g., pristine or substantially pristine graphite) at an interface of a phase separated system (e.g., at an interface of two non-mixing solvents), thereby providing a significant commercial and manufacturing advantage as a result. Some advantages of the improved transparent conductive films of the present disclosure include, without limitation: (i) inexpensive compared to ITO coatings/systems, (ii) flexible compared to ITO coatings/systems, (iii) not in short supply, as is ITO, (iv) no need for high temperature treatment (e.g., as compared with GO coatings/systems), and/or (v) better conductivity (e.g., compared to reduced GO coatings/systems).

In exemplary embodiments, the present disclosure provides for the use of a kinetic interfacial trapping ("KIT") method/technique to assemble transparent (e.g., substantially optically transparent), conductive (e.g., electrically conductive) films of graphene (e.g., one to four layers thick), with no substantial chemical modification of the graphene. In general, the method/technique includes sonicating (e.g., briefly sonicating) graphite in a mixture/system of two non-mixing solvents (e.g., in a phase separated system, such as in a water/heptane mixture).

Minimization of the solvent interfacial tension drives the spreading of graphene at the interface of the phase separated system (e.g., at the water/heptane interface). Molecular dynamics simulations show that the graphene sheets are kinetically trapped at the solvent interface and are unable to restack. The graphene also climbs a substrate (e.g., hydrophilic substrate), thereby forming a graphene film (e.g., one to four layers thick) on the substrate. These exemplary films have been shown to have a potentially limitless lateral dimension, and to possess conductivities of about 400 S/cm.

Thus, in exemplary embodiments, the present disclosure provides for transparent, one to four layer, conductive films of pristine natural flake graphene by kinetically trapping graphene sheets at an interface of a phase separated system (e.g., at an oil/water interface).

In general, creating thin, uniform films of graphene allows for the potential to produce flexible, transparent, conductive coatings. For example, applications of these films/coatings are found in such devices as solar cells, super capacitors, batteries, and flexible displays (see, e.g., C. Biswas et al., *Advanced Functional Materials* 21, 3806 (2011); X. Wang et al., *Nano Letters* 8, 323 (2008)).

In exemplary embodiments, the use of untreated and unmodified natural (or synthetic) flake graphite to produce transparent conductive films is advantageously provided. The resultant films are typically one to four graphene layers thick, inexpensive to produce, and possess high conductivity and transparency. Furthermore, there is substantially no theoretical limit to their lateral size, and such films can be easily transferred to various substrates.

The exemplary films have been characterized by Raman spectroscopy, TEM, FESEM, optical microscopy, and conductivity measurements. Additionally, computer simulations have been utilized to demonstrate that the exemplary films are formed by a kinetic trapping mechanism that prevents the re-stacking of graphene sheets comprising the film.

The present disclosure will be further described with respect to the following examples; however, the scope of the disclosure is not limited thereby. The following examples illustrate the advantageous systems/methods of the present disclosure of fabricating improved films/coatings (e.g., transparent conductive films/coatings).

Example 1

Figure 2:
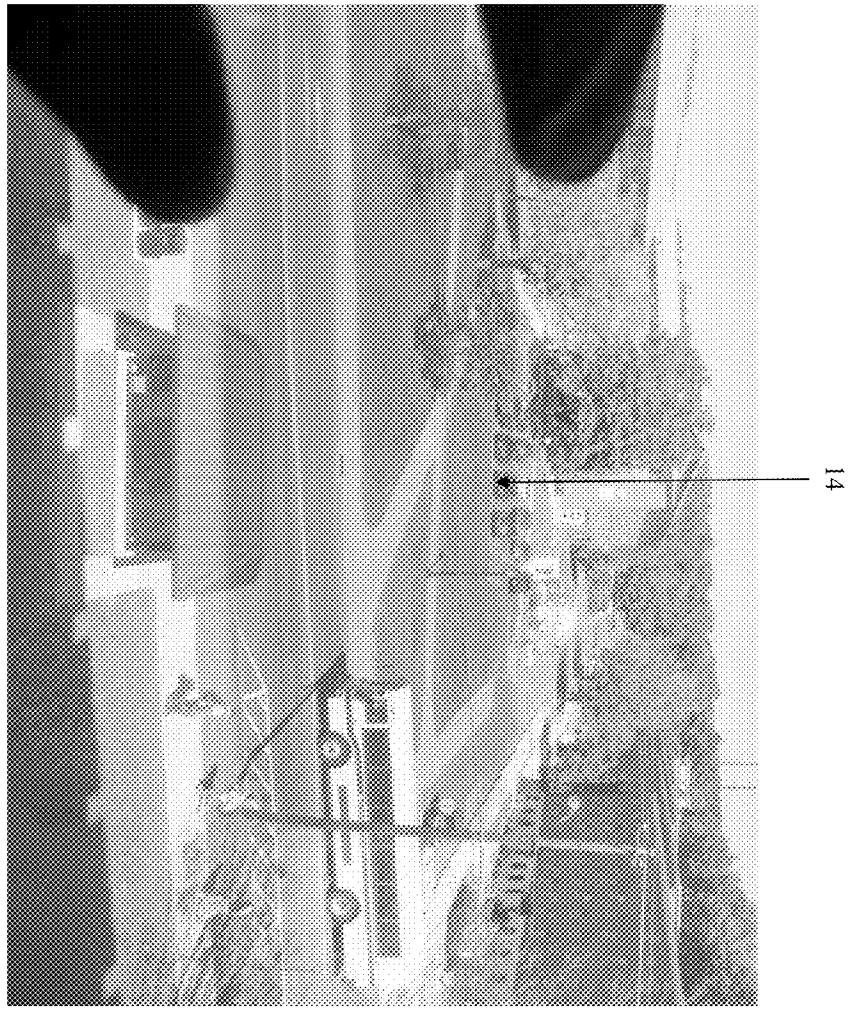
FIG. 2 is an image of an exemplary transparent film of graphene on a substrate (e.g., on a glass slide)

In certain embodiments, when two non-mixing solvents (e.g., heptane and water) are placed together in a housing/container 10 (e.g., glass sample vial), they will form an interface 12 of a phase separated system (FIG. 1). When pristine or substantially pristine graphite is placed in this phase separated system and thereafter sonicated and/or agitated (e.g., via shaking, mixing, stirring, blending), the graphene will remain at the interface 12, as well as climb the walls of the housing 10 (e.g., glass sample vial) containing the solvents and graphite (FIG. 1). By inserting a substrate 14 (e.g., glass microscope slide) through the interface and agitating (e.g., shaking) the system, the graphene will climb the substrate 14 (e.g., slide—FIG. 2). As shown in FIG. 2, after removal from the solvent or phase separated system in container 10, the graphene on the substrate 14 will dry to form a transparent (e.g., substantially optically transparent) and conductive (e.g., electrically conductive) graphene film (e.g., from about one to about four graphene layers thick).

As FIG. 2 depicts, the film is uniform, transparent, and conductive. In certain embodiments, conductivities of exemplary films of about 200 S/cm and about 400 S/cm have been found/measured.

As such, FIG. 2 shows an image of an exemplary transparent film of graphene on a glass slide 14. In exemplary embodiments, the graphene climbs the slide, and when the slide is removed from the system, the slide is coated with a transparent layer/film of graphene.

Figure 3:
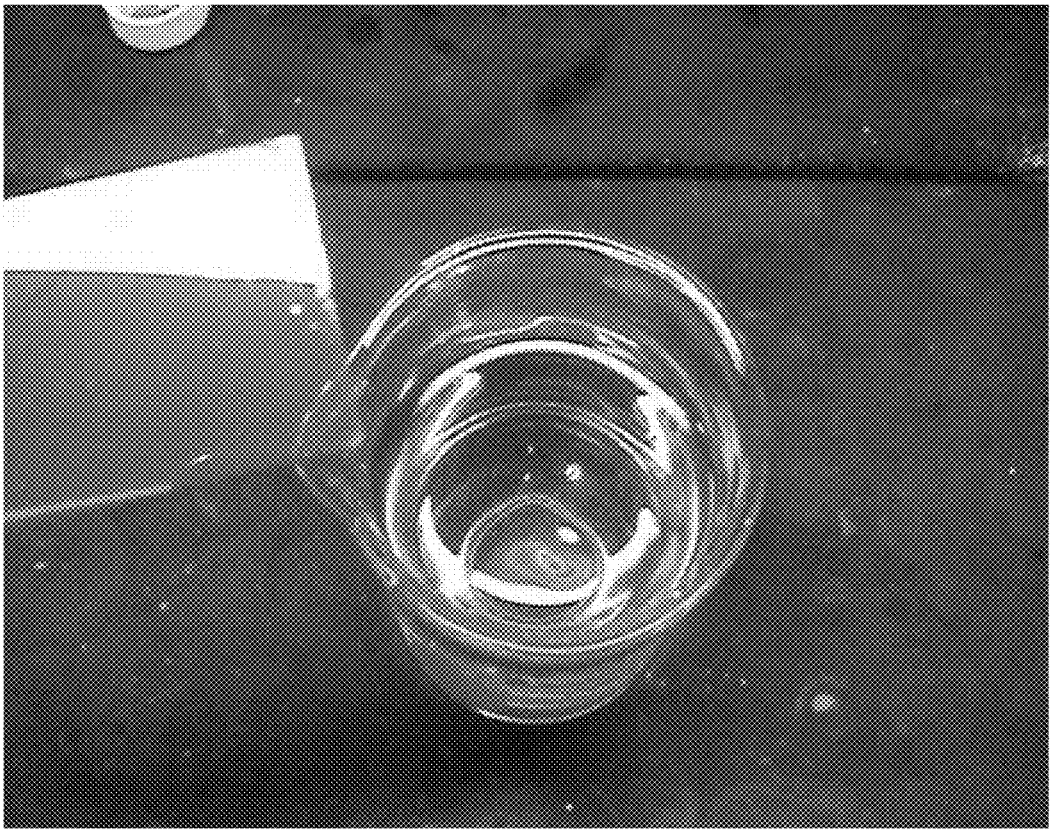
FIG. 3 is an image showing an exemplary film floating on a fluid (e.g., water) surface.
Figure 4:
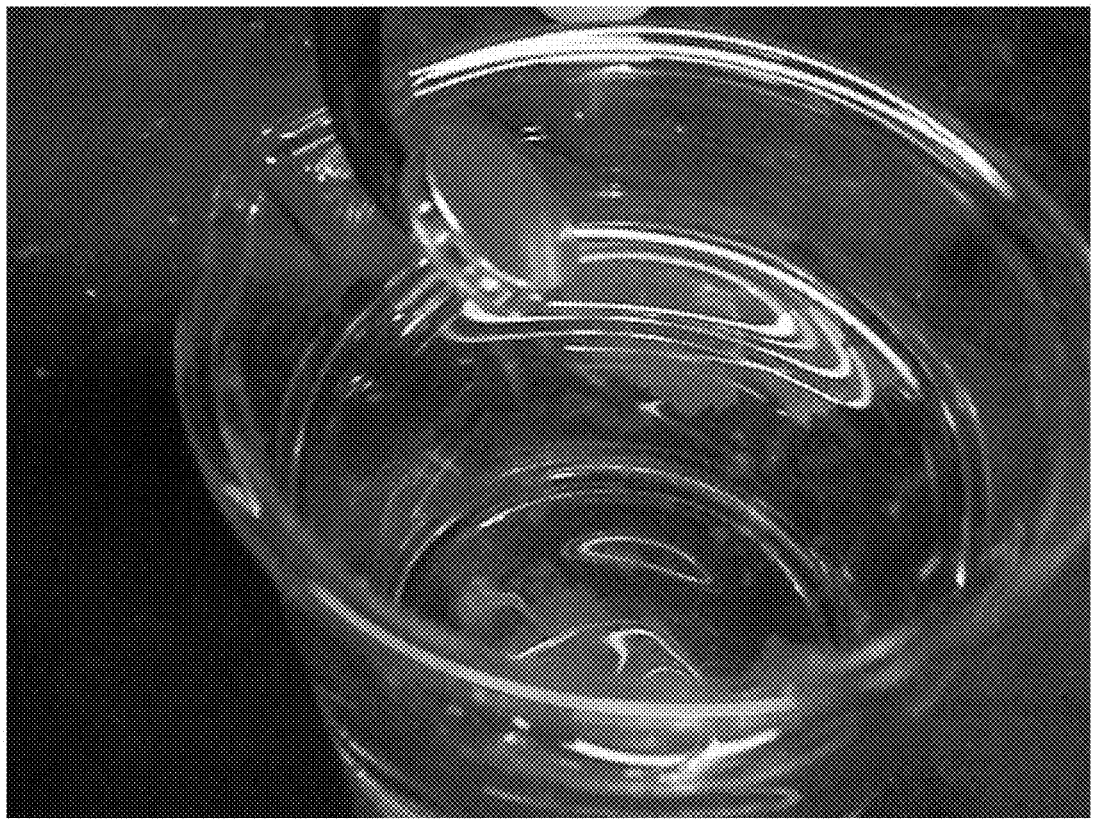
FIG. 4 is an image showing the film being lifted or removed from the fluid surface of FIG. 4.
Figure 5:
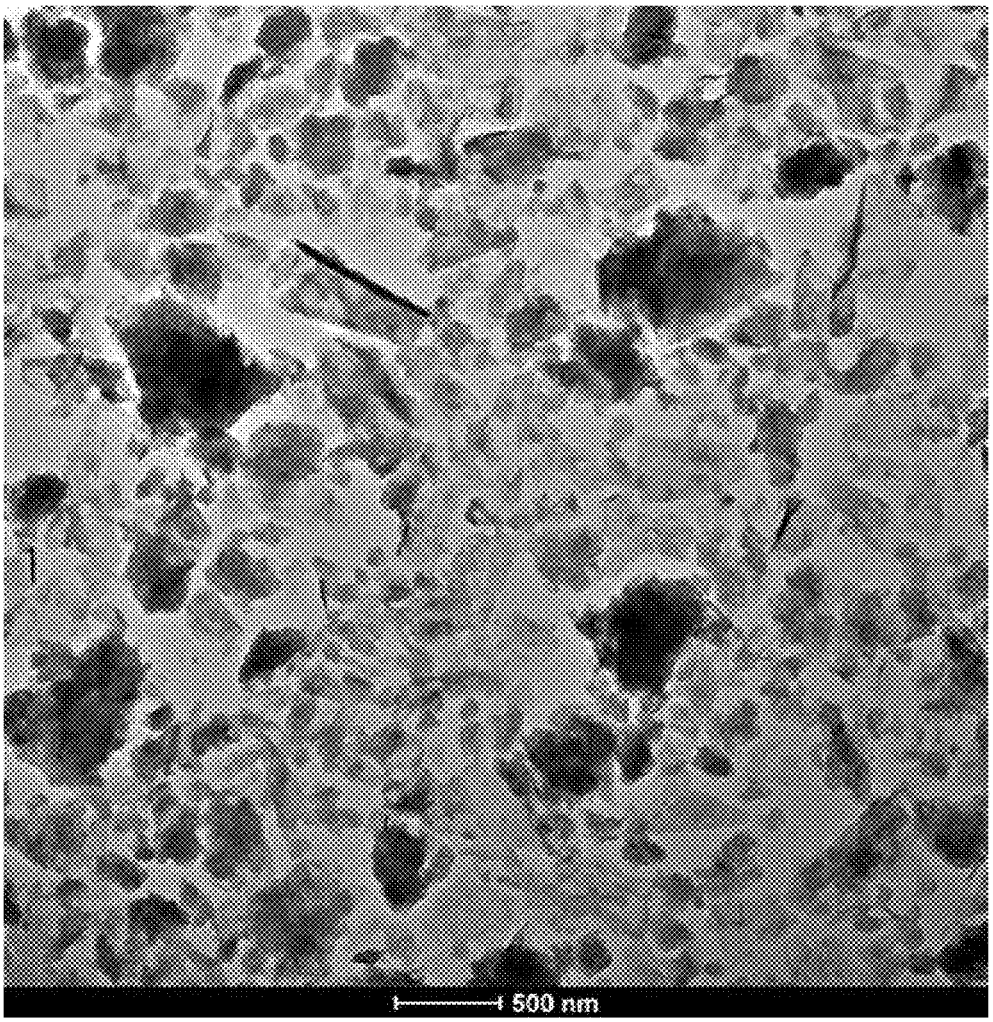
FIG. 5 depicts a TEM image of an exemplary film according to the present disclosure.
Figure 6:
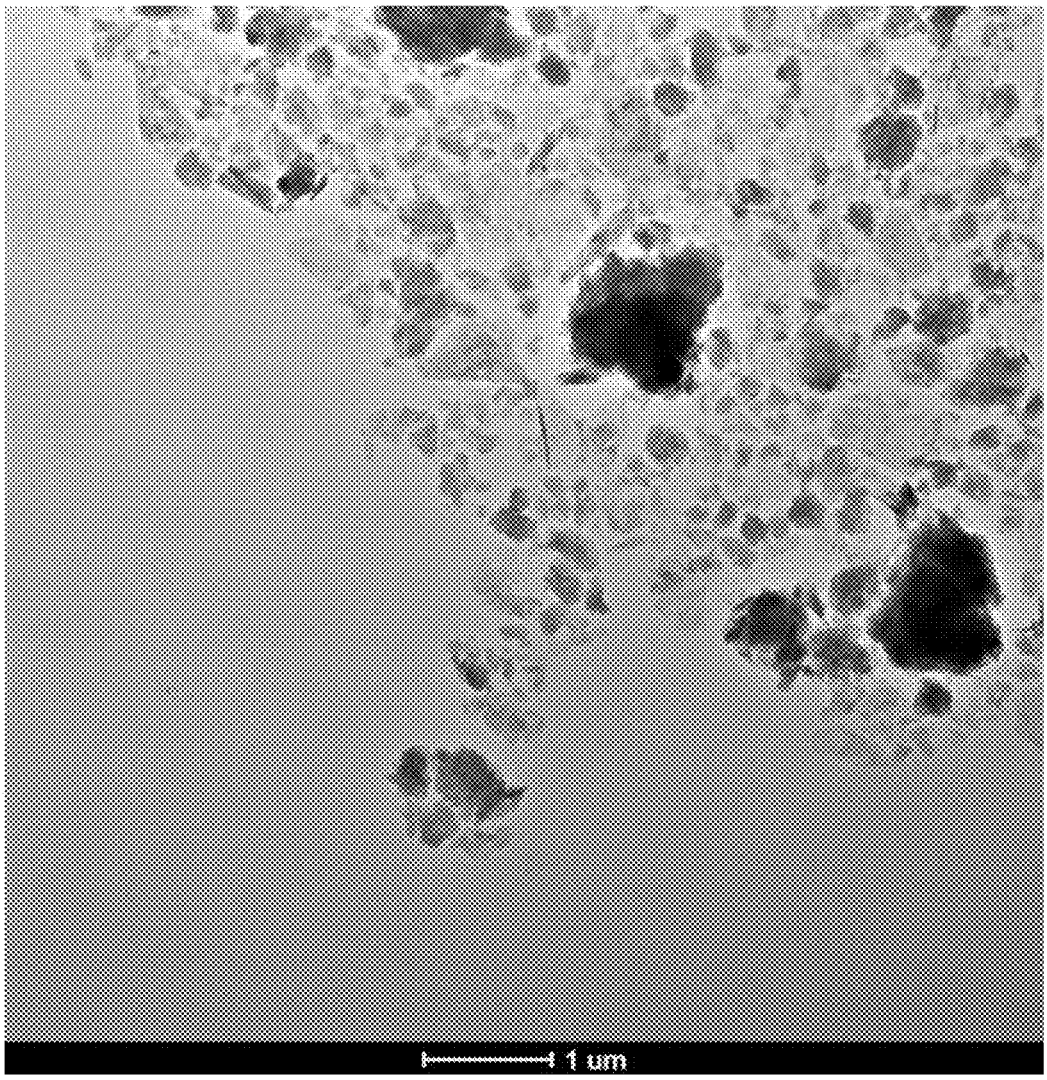
FIGS. 6-9 depict TEM images of another exemplary film according to the present disclosure.
Figure 7:
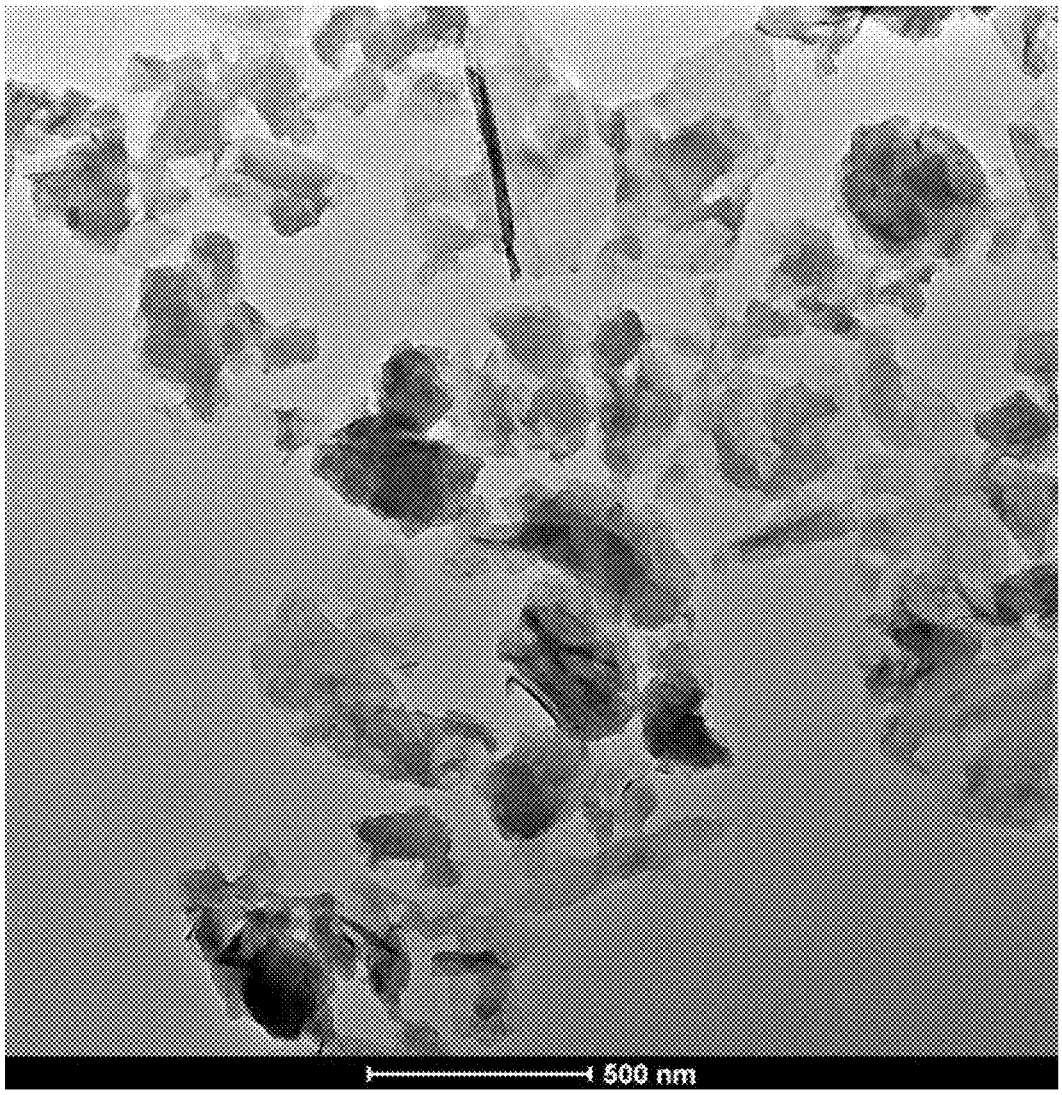
Figure 8:
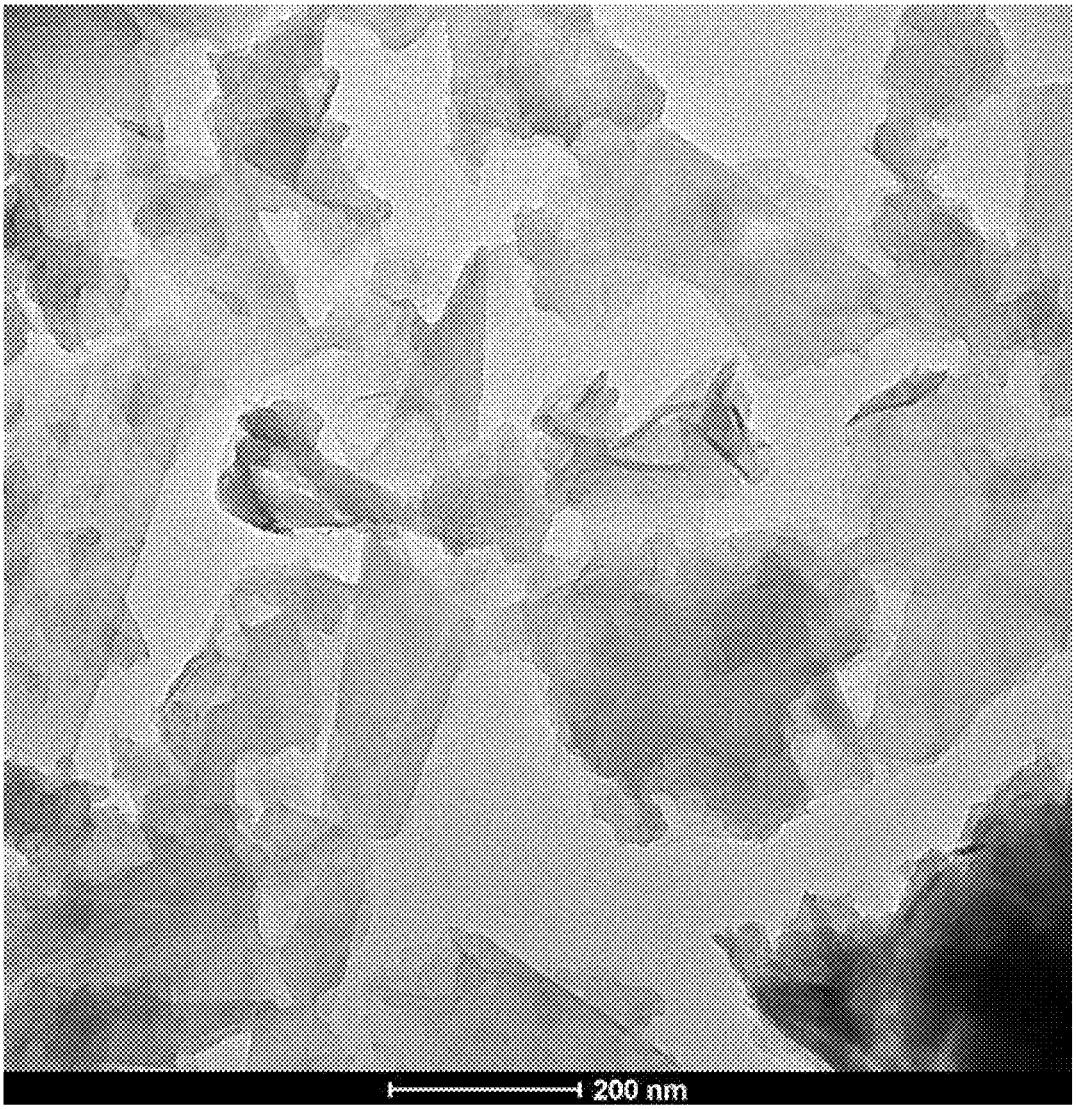
Figure 9:
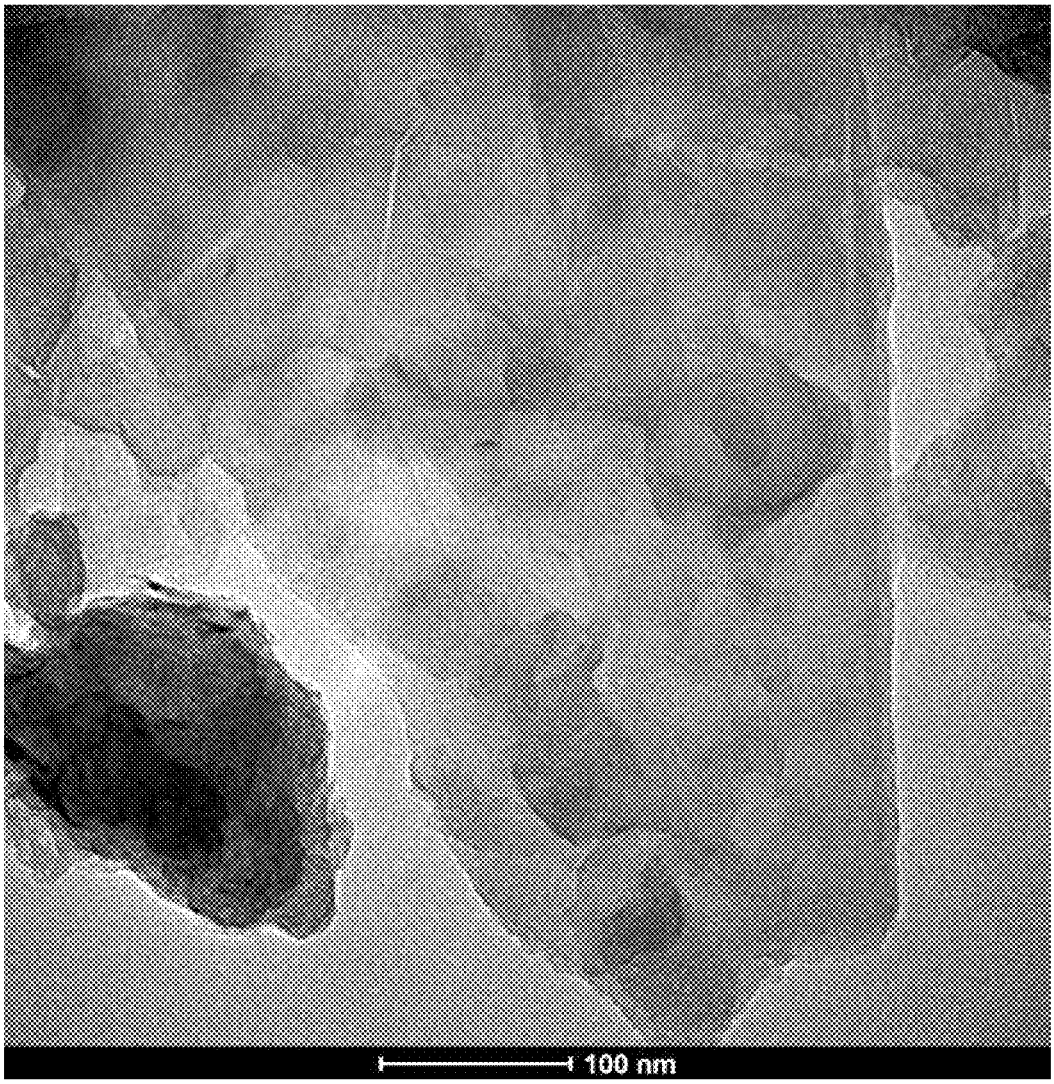

The film can be transferred from the substrate 14 (e.g., glass slide) to other substrates (e.g., metals, plastics, etc.) by floating/moving the film to and/or on a fluid (e.g., to a water surface) (FIG. 3), followed by dipping the new substrate into the fluid to lift/remove the film from the fluid (FIG. 4). It is noted that the exemplary films have been analyzed by Raman spectroscopy, FESEM, TEM and optical microscopy. TEM images of exemplary films are shown in FIGS. 5-9.

In certain embodiments, the film formation occurred at the interface of a water/heptane phase separated mixture. Graphene is generally insoluble in both heptane and water. When graphite (e.g., natural or synthetic graphite) is placed in either water or heptane alone, it typically falls to the bottom of the container. Even when sonicated, graphene generally does not form a stable suspension in either solvent.

Figure 10:
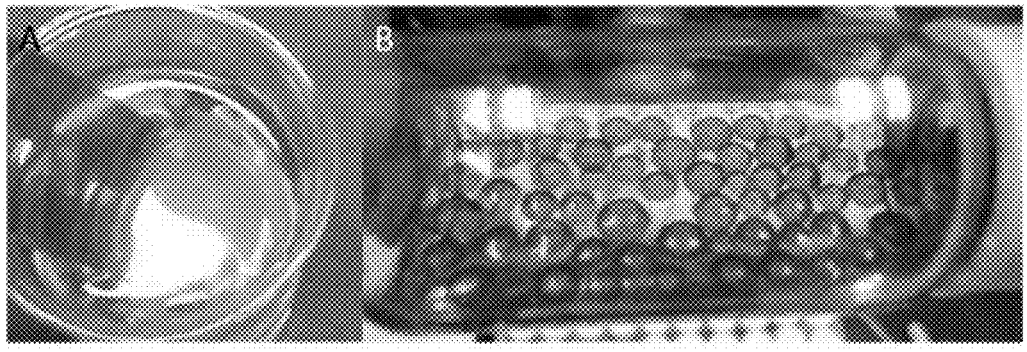
FIG. 10A shows a graphene film lifted off a glass slide onto the surface of water.
FIG. 10B shows droplets of water in heptane stabilized by pristine, natural flake graphene.

When placed in a mixture of the two, however, the graphite falls through the less dense heptane layer but stops at the heptane/water interface. Even macroscopic chunks of graphite are suspended at this interface. FIGS. 10A and 10B show images of graphene film formation at flat and curved water/heptane interfaces. More specifically, FIG. 10A shows a graphene film lifted off a glass slide onto the surface of water. FIG. 10B shows droplets of water in heptane stabilized by pristine, natural flake graphene. As such, FIG. 10B shows a stiff graphene shell stabilizing a water/heptane emulsion. It is noted that by the proper choice of the water/heptane ratio, drops stable enough to coalescence for days can be formed.

Centrifugation of the graphene film at forces greater than about 300,000 g does not lead to the precipitation of the graphene through the water phase. This is despite the density of the graphite being approximately 2.2 g/cc, more than twice that of the water below it. If, however, the heptane is allowed to evaporate from the system, the graphite will fall through the water to the bottom of the vial. Thus, graphene is trapped at the water/heptane interface.

Figure 13:
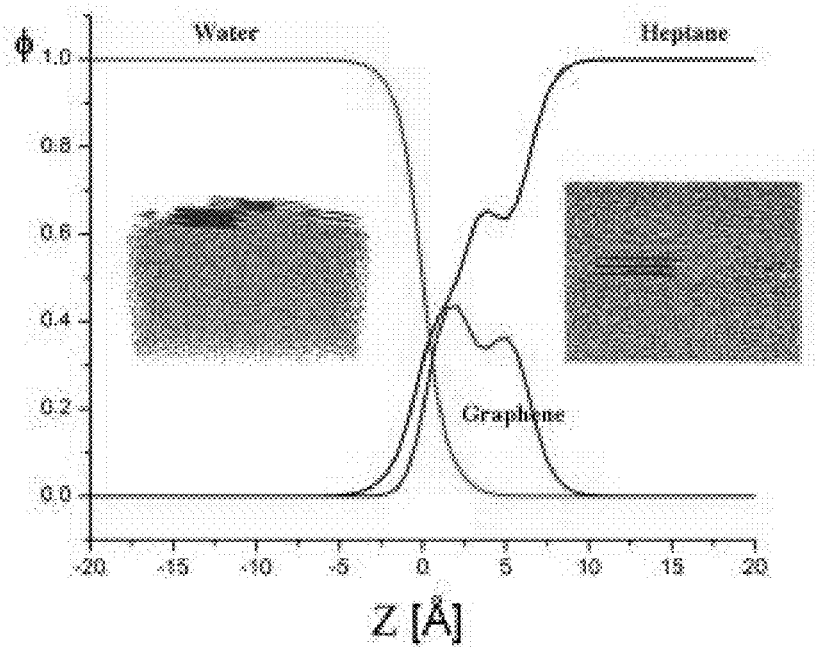
FIG. 13 shows localization of the graphene at the water/heptane interface.
Figure 14:
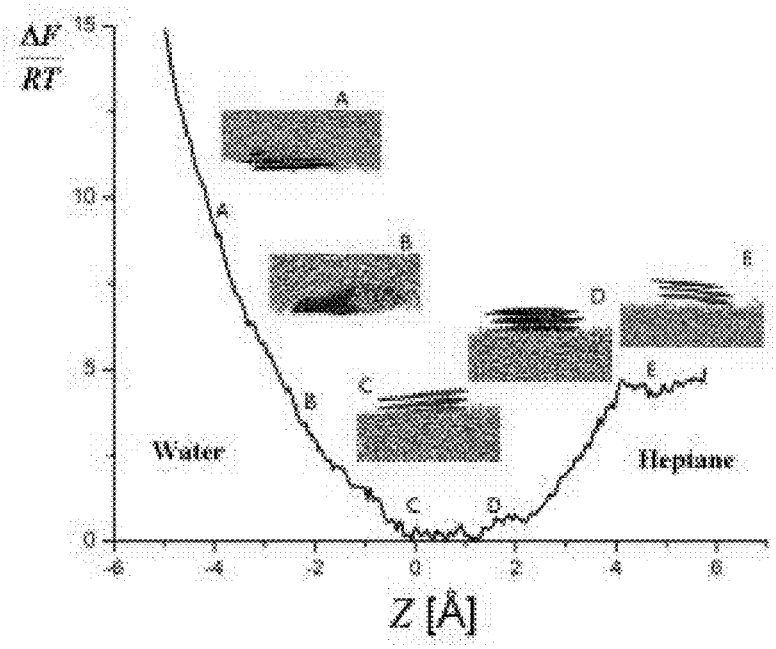
FIG. 14 shows potential of the mean force for a three layer graphene flake assembly.

As noted, FIGS. 10A and 10B show images of graphene thin films formed at the water/heptane interfaces. FIG. 13 shows localization of the graphene at the water/heptane interface. FIG. 14 shows potential of the mean force for a three layer graphene flake assembly.

It is noted that the present disclosure provides for methods of graphene sheets spreading at the oil/water interface to lower the interfacial energy of the system.

While the presence of immiscible molecules at the interface might be expected to lower the interfacial energy, in practice this generally is not the case as the immiscible molecules are effectively attracted to one another and do not spread on the interface (see, e.g., T. A. Witten et al., *Structured Fluids*, Polymers, Colloids, Surfactants (Oxford University Press, USA), pp. 216 (2010)). It is noted that the energy driving the process can be seen by examining the energies associated with the system.

The surface tension of water is $\gamma_w$=72.86 mN/m at about 20° C., and the surface tension of heptane at the same temperature is $\gamma_h$=20.14 mN/m. The surface free energy of natural flake graphite has been measured to be $\gamma_g$=54.8 mJ/m$^2$. (Coleman, *Advanced Functional Materials* 19, 3680 (2009); S. Wang et al., *Langmuir* 25, 11078 (2009)). What is apparent from these values is that neither heptane nor water are good solvents for graphene, the water/heptane interfaces are high energy, and the surface energy of graphene lies nearly in the middle of water and heptane. (J. N. Coleman et al., *Science* 331, 568 (2011)).

An estimate of the spreading parameter S by using value of the surface energies of the pure components with air ($\gamma_w$, $\gamma_h$, $\gamma_g$) show that it is positive S≈6.61 mJ/m$^2$. Therefore, graphene will spread at the water/heptane interface and lower its surface energy. Note that the graphene will reside at the interface as long as the surface tension forces are stronger than the gravitational force, which is true for graphene layers thinner than corresponding capillary length, e.g., about 1 mm.

To confirm the strong affinity between graphene and the water/heptane interface, detailed molecular dynamics simulations were performed of several graphene sheets (about 1-9 sheets) dispersed at a water/heptane mixture. The simulations were done at generally normal conditions (e.g., temperature about 300 K, and pressure of about 1 atm).

During simulations, the graphene sheets moved along the interface forming stacks about two and three sheets thick. FIG. 13 shows the density distribution along the z-axis in simulations with nine graphene sheets.

In certain embodiments, it appears that graphene aggregates are located at the water/heptane interface with a slight preference towards the heptane phase. The formation of the aggregates having more than three sheets was not observed. This is a result of an increase in aggregate bending rigidity, with increasing number of sheets in an aggregate resulting in a large bending energy penalty for initiation of a new sheet addition.

The affinity between graphene aggregates and the heptane/water interface was evaluated by calculating the potential of the mean force between a three sheet thick graphene aggregate and the interface (see FIG. 14).

These simulations were performed at about constant volume and temperature, thus showing the change in the Helmholtz free energy of the aggregate as it is displaced from the water/heptane interface. It is noted that the minimum of the potential is located at the water/heptane interface. It grows faster towards the water phase, confirming that the water is a poorer solvent for graphene than is heptane. In the heptane phase, the potential saturates at about 5 Å. The magnitude of the potential is on the order of about 5 RT at a displacement of approximately 4 Å from the aggregate center of mass relative to its initial position. This indicates a strong affinity of graphene aggregates for the water/heptane interface. Note that in a system consisting of large graphene sheets, this energy difference should be even larger, thereby pinning graphene to the interface even more efficiently.

Also, for larger sheets, the formation of thick aggregates is suppressed due to the necessity of diffusing large distances along the interface to form stacks. The lack of re-stacking due to kinetic trapping is a feature unique to the kinetic interface trapping (KIT) process of the present disclosure.

Figure 11:
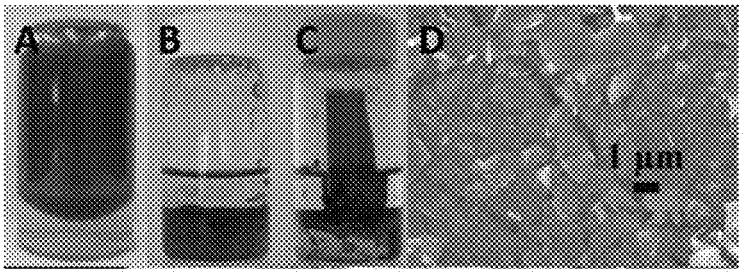
FIG. 11A displays a glass sample vial containing water, heptane, and graphene, and showing the graphene film coating the glass from the water/heptane interface up to the top of the vial.
FIG. 11B displays a glass vial made hydrophobic by treatment with a chlorosilane, where graphene is observed at the hydrophobic/water interface of the lower phase, but substantially no climbing is observed above the water layer.
FIG. 11C displays a vial as in FIG. 11B, but with an untreated glass slide inserted, and where the graphene climbs the slide even as it does not climb the hydrophobic glass vial.
FIG. 11D shows a field emission scanning electron microscope (FESEM) image of exemplary graphene film of the present disclosure.

In a glass vial after the sonication energy is removed, in addition to spreading on the water/heptane interface, the graphene climbs the walls of the glass sample vial as illustrated in FIGS. 11A-C. As the glass of the vial is hydrophilic, a thin layer of water is present on the surface and is in contact with the heptane vapor, leading to a high-energy interface. Graphene sheets climb (e.g., move/travel up) this surface to minimize the interfacial energy, leading to thin graphene films. It is noted that the climbing of the graphene indicates that the corresponding Hamaker constant of the glass/water/graphene/heptane vapor system is negative.

As the glass provides a hydrophilic surface necessary to form the water/heptane interface, a hydrophobic surface should generally not lead to climbing. Polyethylene vials showed graphene at the interface, but substantially no climbing. If a glass slide is introduced to the system, however, the film immediately started to climb up the sides of the slide. Further evidence for the need of a hydrophilic surface is provided by partially treating the glass slide with chlorotrimethylsilane. The region treated with silane contains no graphene, while the surrounding area is evenly coated with graphene.

It was observed that graphite of smaller flake size climbed the glass faster than did the larger graphite. This also resulted in single or a few layers of graphene sheets preferentially climbing the glass surfaces. Once a graphene sheet stabilized the heptane/water interface, the driving force to pull up more sheets is substantially eliminated, resulting in the vertical glass surface of the vial advantageously being coated by a thin layer of highly exfoliated graphene sheets.

FIGS. 11A-D show graphene thin film preparation and analysis. More specifically, FIG. 11A displays a glass sample vial containing water, heptane, and graphene, and showing the graphene film coating the glass from the water/heptane interface up to the top of the vial.

FIG. 11B displays a glass vial made hydrophobic by treatment with a chlorosilane. Graphene is observed at the hydrophobic/water interface of the lower phase, but substantially no climbing is observed above the water layer.

FIG. 11C displays a vial as in FIG. 11B, but with an untreated glass slide inserted. The graphene climbs the slide even as it does not climb the hydrophobic glass vial. As discussed further below, FIG. 11D shows a field emission scanning electron microscope (FESEM) image of an exemplary graphene film of the present disclosure.

In certain embodiments, the film produced by the KIT process on the walls of the vial was substantially curved, and provided a somewhat difficult film geometry for study. To address this issue, a glass microscope slide was placed in the sample vial, with the slide passing through both the heptane and the water phase. The graphene climbed the slide, just as it did the walls of the vial. The slide was then removed and the heptane allowed to evaporate. Optical transmission and electrical conductivity measurements were then performed on the film.

As noted, FIG. 11D shows an FESEM image of the film. The film was seen to be composed of overlapping sheets of roughly micron dimensions. These large size sheets are possible due to only brief, mild sonication being desired for the graphene exfoliation. The trenches in FIG. 11D are characteristic of the aluminum stub used to mount the sample. FIG. 2 illustrates such a film, with a graphene layer on both the back and front of the slide 14.

The use of an interface to produce non-transparent GO and rGO films has been demonstrated previously. In these previous investigations, dispersing the graphitic materials in one of the solvent phases was the initial step. For example, graphene nanosheets, prepared by heating acid treated graphite have been used to form thin films from chloroform dispersions upon the addition of water. The requirement of first forming a dispersion is the major reason for the widespread use of the water dispersible GO. Even in investigations using more hydrophobic graphitic materials, dispersing the sheets in solvents such as NMP or chloroform was a central aspect of the process.

In distinct contrast to these prior investigations, the present disclosure advantageously provides that by placing graphene at the interface of two immiscible solvents, this thereby results in a condition where the graphene acts to stabilize the solvent/solvent interface, thus lowering the energy of the system. Since the graphene is not stabilized in either solvent, it remains pinned at the interface.

It has been found that using systems in which the graphitic material can be dispersed in one of the solvents does not lead to the climbing phenomena that forms the exemplary transparent films of the present disclosure. For example, the use of GO or functionalized graphene sheets (FGS) produced by the thermal exfoliation and reduction of GO, does not result in climbing graphene, nor does the use of solvents such as, for example, NMP or DMF.

Figure 12:
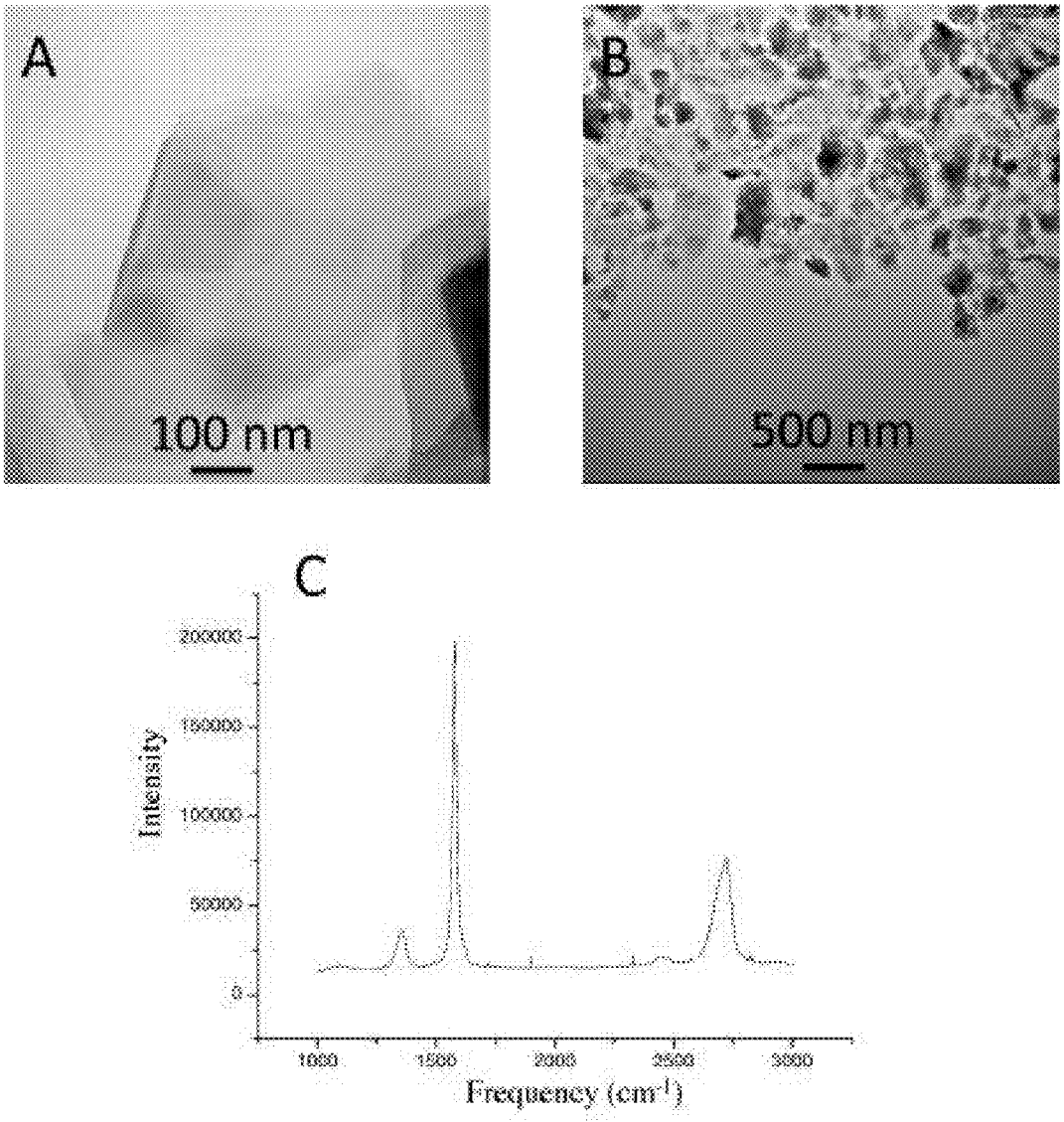
FIGS. 12A and 12B are TEM images that illustrate the one to four layer, overlapping morphology of the exemplary graphene films of the present disclosure.
FIG. 12C depicts a Raman spectra of an exemplary graphene film of the present disclosure, where the shape of the 2D peak is consistent with two layers of graphene.

FIGS. 12A-C depict characterizations of exemplary graphene films of the present disclosure. FIGS. 12A and 12B are TEM images that illustrate the one to four layer, overlapping morphology of the exemplary graphene films of the present disclosure.

FIG. 12C depicts a Raman spectra of an exemplary graphene film of the present disclosure. The shape of the 2D peak is consistent with two layers of graphene.

To measure the conductivity of the film, two approaches were utilized. The transparency of the film was measured at 550 nm. The film transparency was found to be as high as about 94%. Conductivities were found to be as high as about 1,000 S/cm. Conductivities were measured using the four point probe technique.

In order to place the graphene film on a substrate other than glass, a lift off technique was employed. FIGS. 12A and 12B show TEM images obtained by first floating the graphene film on water, then placing the film on a TEM grid. The graphene film lifted off of the glass slide and floated on the water. This allowed for placing the film on hydrophobic plastic or metal surfaces. The film was observed to be composed of overlapping graphene sheets. Spaces containing substantially no graphene were also observed, and image analysis of the TEM images indicated that nearly 20% of the film surface contained substantially no graphene.

The overlapping graphene sheets served to hold the film together, as shown by the coherent films on the water surface after lift off. The thickness of the film can be analyzed by several methods. The use of Raman spectroscopy to determine the number of layers in a graphene stack has been previously developed. Comparing the spectra of the exemplary films of the present disclosure, as shown in FIG. 12D, with literature examples indicated a stacking of approximately two sheets. The lift off technique was also used to prepare samples for FESEM analysis.

In exemplary embodiments, the formation of a transparent, conductive film (e.g., graphene film) by kinetically trapping at least a portion of a layered material (e.g., exfoliated graphene sheets) at a liquid interface has been demonstrated. Computational studies have shown that this KIT process is the result of the strong affinity of the sheets to the interface, prohibiting sheets from sliding on top of each other forming re-stack graphene layers. Characterization of the exemplary films included Raman spectroscopy, TEM, FESEM, and conductivity and transparence measurements. The advantageous methods/techniques of the present disclosure are easy to perform, inexpensive, applicable to a wide range of surfaces/substrates, scalable, can utilize pristine and/or natural flake graphite with no prior treatment, and/or require no post-treatments such as chemical reduction or heating.

Whereas the disclosure has been described principally in connection with graphite and/or graphene, such description has been utilized for purposes of disclosure and is not intended as limiting the disclosure. To the contrary, it is recognized that the disclosed systems, methods, techniques and assemblies are capable of use with other materials having a layered structure or the like, such as, for example, boron nitride (e.g., hexagonal or graphitic boron nitride).

Although the systems and methods of the present disclosure have been described with reference to exemplary embodiments thereof, the present disclosure is not limited to such exemplary embodiments and/or implementations. Rather, the systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

The invention claimed is:

1. A method for fabricating a film or coating, comprising:

a) providing a phase separated system, the phase separated system including: (i) a first liquid material and a second liquid material, and (ii) an interface between the first and second liquid materials;

b) introducing a layered material to the phase separated system, wherein the layered material spreads at the interface;

c) inserting a substrate into the interface of the phase separated system and allowing at least a portion of the layered material to be associated with the substrate; and d) removing the substrate from the phase separated system and allowing the portion of the layered material associated with the substrate to dry.

2. The method of claim 1, wherein the layered material includes graphite.

3. The method of claim 1, wherein the layered material is substantially pristine and naturally derived graphite.

4. The method of claim 1, wherein the dried portion of the layered material associated with the substrate is substantially transparent and electrically conductive.

5. The method of claim 1, wherein the phase separated system is an oil and water based system.

6. The method of claim 1, wherein the phase separated system is a system of two substantially non-mixing solvents.

7. The method of claim 1, wherein the first material is water and the second material is heptane.

8. The method of claim 1, wherein the substrate includes glass.

9. The method of claim 1, wherein the substrate is substantially hydrophilic.

10. The method of claim 1, wherein after inserting the substrate into the interface of the phase separated system, at least a portion of the layered material moves along a surface of the substrate.

11. The method of claim 1, wherein the portion of the layered material associated with the substrate includes graphene.

12. The method of claim 1, wherein the portion of the layered material associated with the substrate includes from about one sheet or layer to about four sheets or layers of graphene.

13. The method of claim 12, wherein the graphene is substantially pristine natural flake graphene.

14. The method of claim 1, wherein in connection with step b), the phase separated system is sonicated or agitated.

15. The method of claim 1, wherein during step c), the phase separated system is sonicated or agitated.

16. The method of claim 1, further comprising the steps of:

e) inserting the substrate and the dried portion of the layered material associated with the substrate into a fluid so that the dried portion of the layered material floats on or in the fluid;

f) inserting a second substrate into the fluid; and g) removing the dried portion of the layered material from the fluid via the second substrate.

17. The method of claim 16, wherein the fluid is water.

18. The method of claim 16, wherein the second substrate is metal or plastic.

19. A method for fabricating a film or coating, comprising:

a) providing a phase separated system, the phase separated system including: (i) water and heptane, and (ii) an interface between the water and the heptane;

b) introducing substantially pristine graphite to the phase separated system;

c) sonicating the phase separated system, wherein the substantially pristine graphite spreads at the interface;

d) inserting a hydrophilic substrate into the interface of the phase separated system and allowing at least a portion of the substantially pristine graphite to be associated with the hydrophilic substrate; and e) removing the hydrophilic substrate from the phase separated system and allowing the portion of the substantially pristine graphite associated with the hydrophilic substrate to dry;

wherein the dried portion of the substantially pristine graphite associated with the substrate is substantially transparent and electrically conductive;

wherein after inserting the hydrophilic substrate into the interface of the phase separated system, at least a portion of the substantially pristine graphite moves along a surface of the hydrophilic substrate;

wherein the portion of the substantially pristine graphite associated with the hydrophilic substrate includes from about one sheet or layer to about four sheets or layers of graphene; and wherein during step d), the phase separated system is sonicated or agitated.

20. A method for fabricating a film or coating comprising:

a) providing a phase separated system, the phase separated system including: (i) water and heptane, and (ii) an interface between the water and the heptane;

b) introducing substantially pristine graphite to the phase separated system;

c) sonicating the phase separated system, wherein the substantially pristine graphite spreads at the interface;

d) inserting a hydrophilic substrate into the interface of the phase separated system and allowing at least a portion of the substantially pristine graphite to be associated with the hydrophilic substrate;

e) removing the hydrophilic substrate from the phase separated system and allowing the portion of the substantially pristine graphite associated with the hydrophilic substrate to dry;

f) inserting the substrate and the dried portion of the substantially pristine graphite associated with the hydrophilic substrate into a fluid so that the dried portion of the substantially pristine graphite floats on or in the fluid;

g) inserting a second substrate into the fluid; and h) removing the dried portion of the substantially pristine graphite from the fluid via the second substrate;

wherein the dried portion of the substantially pristine graphite is substantially transparent and electrically conductive.

* * * * *